US010546680B2

(12) United States Patent
Park et al.

(10) Patent No.: US 10,546,680 B2
(45) Date of Patent: Jan. 28, 2020

(54) COIL ELECTRONIC COMPONENT WITH ANISOTROPIC PARTS AND METHOD OF MANUFACTURING THE SAME

(71) Applicant: SAMSUNG ELECTRO-MECHANICS CO., LTD., Suwon-si, Gyeonggi-do (KR)

(72) Inventors: Moon Soo Park, Suwon-si (KR); Ji Hyun Eom, Suwon-si (KR); Jae Yeol Choi, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 55 days.

(21) Appl. No.: 15/093,336

(22) Filed: Apr. 7, 2016

(65) Prior Publication Data

US 2017/0004915 A1 Jan. 5, 2017

(30) Foreign Application Priority Data

Jul. 1, 2015 (KR) ..... 10-2015-0094037

(51) Int. Cl.
*H01F 27/255* (2006.01)
*H01F 27/28* (2006.01)

(52) U.S. Cl.
CPC ..... *H01F 27/255* (2013.01); *H01F 27/2823* (2013.01)

(58) Field of Classification Search
CPC ..... H01F 27/255
See application file for complete search history.

(56) References Cited

U.S. PATENT DOCUMENTS

| | | | | |
|---|---|---|---|---|
| 7,859,377 | B2 | 12/2010 | Kawarai | |
| 8,975,997 | B2 | 3/2015 | Tonoyama et al. | |
| 9,773,611 | B2 | 9/2017 | Kim et al. | |
| 2004/0141297 | A1* | 7/2004 | Tokuda | H01F 17/0013 361/762 |
| 2005/0142353 | A1* | 6/2005 | Buczek | B05D 3/00 428/323 |

(Continued)

FOREIGN PATENT DOCUMENTS

| | | | |
|---|---|---|---|
| CN | 101615490 | A | 12/2009 |
| CN | 101896983 | A | 11/2010 |

(Continued)

OTHER PUBLICATIONS

Korean Office Action dated Jun. 16, 2016, issued in Korean Patent Application No. 10-2015-0094037. (w/ English tanslation).

(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil electronic component includes coil parts formed on both surfaces of a support part and a magnetic body enclosing the support part and the coil parts. The magnetic body includes a dipping coating part formed around the coil part, a core part formed inside the coil part, an outer peripheral part formed outside the coil part, and first and second cover parts formed above and below the coil part. The dipping coating part contains metal powder having shape anisotropy.

22 Claims, 14 Drawing Sheets

(56) References Cited

U.S. PATENT DOCUMENTS

2009/0002117 A1* 1/2009 Kawarai ..... H01F 17/0006 336/233
2009/0243780 A1* 10/2009 Inoue ..... H01F 1/15366 336/200
2009/0295526 A1* 12/2009 Mikami ..... C01G 49/009 336/196
2010/0308949 A1* 12/2010 Lim ..... H01F 17/0013 336/218
2012/0105188 A1* 5/2012 Lim ..... H01F 17/0033 336/200
2012/0105190 A1* 5/2012 Mitani ..... H01F 3/14 336/221
2013/0113593 A1* 5/2013 Jeong ..... H01F 17/0013 336/200
2013/0249662 A1* 9/2013 Tonoyama ..... H01F 27/255 336/200
2014/0097927 A1* 4/2014 Yamamoto ..... H01F 1/344 336/200
2014/0167897 A1* 6/2014 Choi ..... H01F 27/255 336/83
2014/0327394 A1* 11/2014 Asselin ..... H01F 3/10 320/108
2015/0109088 A1 4/2015 Kim et al.
2016/0099098 A1* 4/2016 Yamaguchi ..... H01F 17/0006 336/221

FOREIGN PATENT DOCUMENTS

CN 102449710 A 5/2012
CN 103366919 A 10/2013
CN 104575937 A 4/2015
JP 2006-278479 A 10/2006
JP 2009-009985 A 1/2009
JP 2015-082660 A 4/2015
KR 10-2014-0077346 A 6/2014

OTHER PUBLICATIONS

Office Action issued in Chinese Patent Application No. 201610284868.8, dated Jul. 28, 2017 (with English Machine translation).

* cited by examiner

COIL ELECTRONIC COMPONENT WITH ANISOTROPIC PARTS AND METHOD OF MANUFACTURING THE SAME

CROSS-REFERENCE TO RELATED APPLICATION

This application claims benefit of priority to Korean Patent Application No. 10-2015-0094037, filed on Jul. 1, 2015 with the Korean Intellectual Property Office, the disclosure of which is incorporated herein by reference.

TECHNICAL FIELD

The present disclosure relates to a coil electronic component and a method of manufacturing the same.

BACKGROUND

An inductor, a coil electronic component, is a representative passive element configuring an electronic circuit together with a resistor and a capacitor to remove noise.

The inductor may be manufactured by forming a coil part, hardening a metal powder-resin composite in which metal powders and a resin are mixed with each other to manufacture a magnetic body enclosing the coil part, and forming external electrodes on outer surfaces of the magnetic body.

SUMMARY

An aspect of the present disclosure may provide a coil electronic component of which inductance (L) is improved by implementing high magnetic permeability.

According to an aspect of the present disclosure, a coil electronic component including a dipping coating part formed by dipping a coil part in a slurry containing metal powder having shape anisotropy, and a method of manufacturing the same, may be provided.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
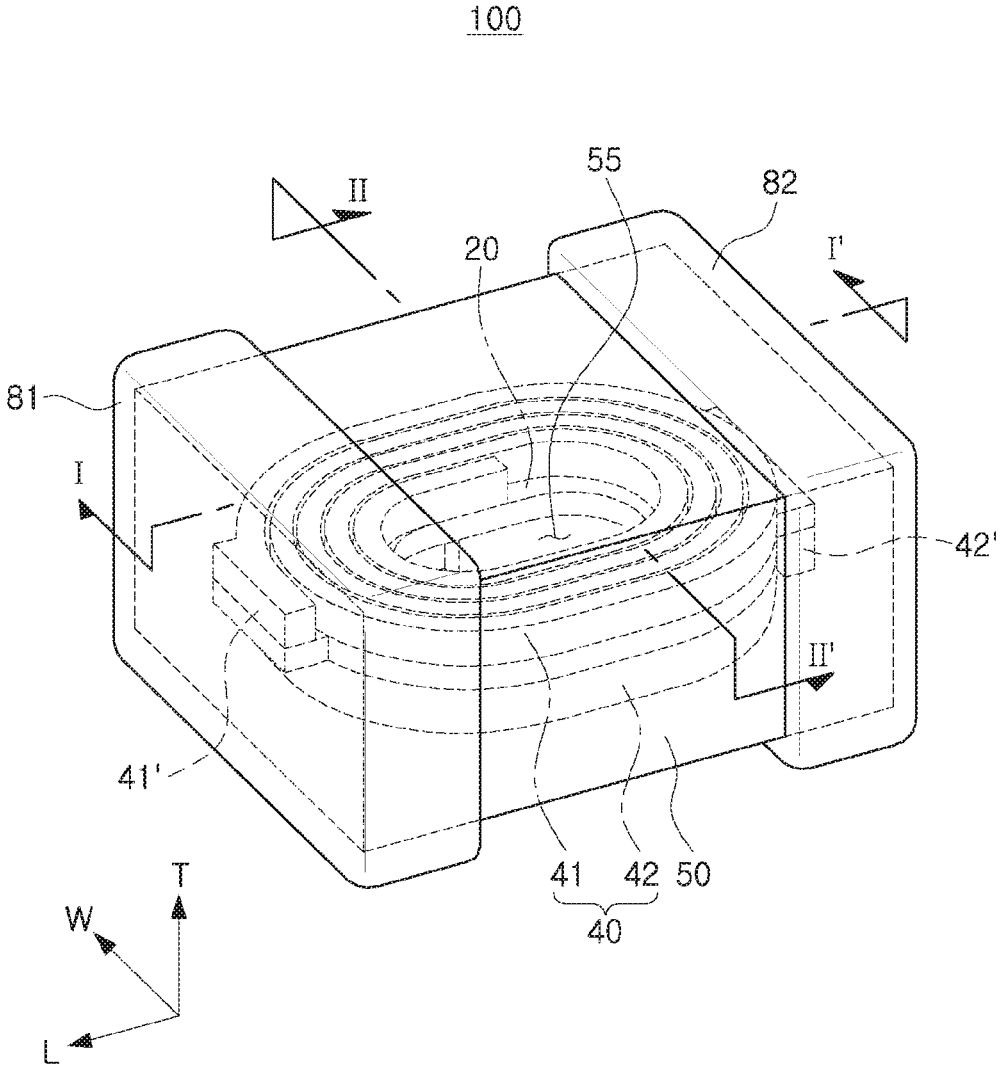
FIG. 1 is a perspective view illustrating a coil electronic component according to an exemplary embodiment in the present disclosure so that a coil part of the coil electronic component is visible.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a required configuration herein, but are not limited thereto.

Coil Electronic Component

Hereinafter, a coil electronic component according to an exemplary embodiment in the present disclosure, particularly, a thin film type inductor will be described. However, the coil electronic component according to an exemplary embodiment is not limited thereto.

FIG. 1 is a perspective view illustrating a coil electronic component according to an exemplary embodiment so that a coil part of the coil electronic component is visible.

Referring to FIG. 1, a thin film type power inductor used in a power line of a power supply circuit is disclosed as an example of the coil electronic component.

A coil electronic component 100 according to an exemplary embodiment may include coil parts 40 formed on both surfaces of a support part 20, a magnetic body 50 enclosing the support part 20 and the coil parts 40, and first and second external electrodes 81 and 82 disposed on outer surfaces of the magnetic body 50 and connected to the coil parts 40.

In the coil electronic component 100 according to an exemplary embodiment, a 'length' direction refers to an 'L' direction of FIG. 1, a 'width' direction refers to a 'W' direction of FIG. 1, and a 'thickness' direction refers to a 'T' direction of FIG. 1.

The coil part 40 may be formed by connecting a first coil conductor 41 formed on one surface of the support part 20 and a second coil conductor 42 formed on the other surface of the support part 20 opposing one surface of the support part 20 to each other.

Each of the first and second coil conductors 41 and 42 may have a form of plane coils formed on the same plane of the support part 20.

The first and second coil conductors 41 and 42 may have a spiral shape.

The first and second coil conductors 41 and 42 may be formed on the support part 20 through electroplating, but are not limited thereto.

The first and second coil conductors 41 and 42 may be formed of a metal having excellent electrical conductivity, such as silver (Ag), palladium (Pd), aluminum (Al), nickel (Ni), titanium (Ti), gold (Au), copper (Cu), platinum (Pt), or alloys thereof.

The first and second coil conductors 41 and 42 may be coated with an insulating layer (not illustrated in FIG. 1), and thus they may not directly contact a magnetic material forming the magnetic body 50.

The support part 20 may be formed of, for example, a printed circuit board, a ferrite substrate, a metal based soft magnetic substrate, or the like. However, the support part 20 is not limited thereto, and may be formed of any board on which the first and second coil conductors 41 and 42 may be formed and supported.

The support part 20 may have a through-hole formed by removing a central portion thereof, wherein the through-hole may be filled with a magnetic material to form a core part 55 inside the coil part 40.

Since the core part 55 is filled with the magnetic material, an area of a magnetic body through which a magnetic flux passes may be increased to improve inductance (L).

However, the support part 20 is not necessarily included, and the coil part may also be formed of a metal wire without including the support part.

The magnetic body 50 enclosing the coil part 40 may contain any magnetic material that has magnetic properties, such as ferrite or metal powders.

The higher the magnetic permeability of the magnetic material contained in the magnetic body 50 and the larger the area of the magnetic body 50 through which the magnetic flux passes, the higher the inductance (L).

One end portion of the first coil conductor 41 may extend to form a first lead portion 41', which is exposed to one end surface of the magnetic body 50 in the length L direction, and one end portion of the second coil conductor 42 may extend to form a second lead portion 42', which is exposed to the other end surface of the magnetic body 50 in the length L direction.

However, the first and second lead portions 41' and 42' are not limited to being exposed as described above, and may be exposed to at least one surface of the magnetic body 50.

The first and second external electrodes 81 and 82 may be formed on the outer surfaces of the magnetic body 50 to be connected, respectively, to the first and second lead portions 41' and 42' exposed to the end surfaces of the magnetic body 50.

The first and second external electrodes 81 and 82 may be formed of a metal having excellent electrical conductivity, such as copper (Cu), silver (Ag), nickel (Ni), tin (Sn), or the like, or alloys thereof.

Figure 2:
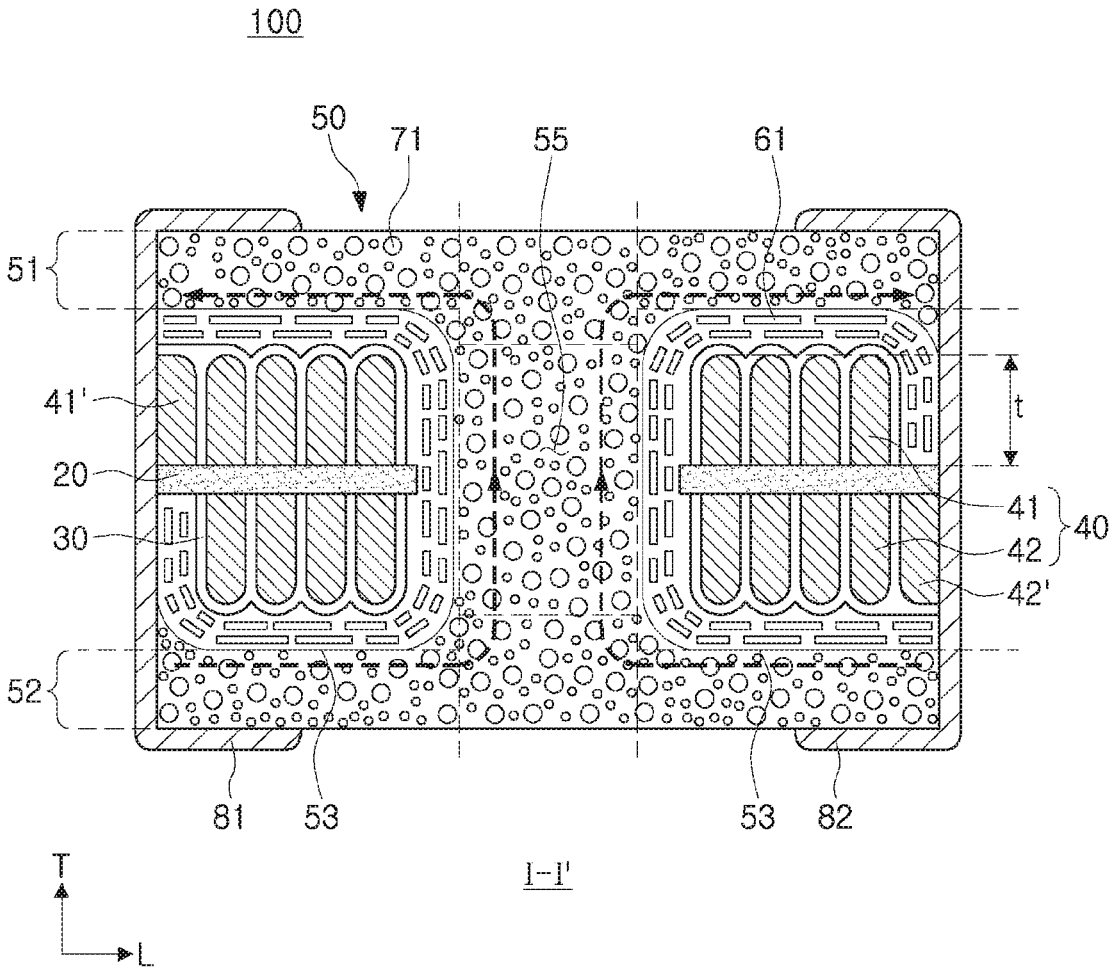
FIG. 2 is a cross-sectional view taken along line I-I' of FIG. 1.

FIG. 2 is a cross-sectional view taken along line I-I' of FIG. 1.

Referring to FIG. 2, the magnetic body 50 of the coil electronic component 100 according to an exemplary embodiment may include dipping coating parts 53 formed around the coil part 40. The dipping coating part 53 may contain metal powders 61 having shape anisotropy.

The magnetic body 50 may include the core part 55 formed inside the coil part 40, an outer peripheral part 54 (see FIG. 4) formed outside the coil part 40, and first and second cover parts 51 and 52 formed above and below the coil part 40. In an exemplary embodiment, the core part 55, the outer peripheral part 54, and the first and second cover parts 51 and 52 may contain metal powder 71 having shape isotropy.

The metal powder 61 having the shape anisotropy and the metal powder 71 having the shape isotropy may be formed of a metal containing one or more selected from the group consisting of iron (Fe), silicon (Si), boron (B), chrome (Cr), aluminum (Al), copper (Cu), niobium (Nb), and nickel (Ni), or alloys thereof, and may be formed of a crystalline or amorphous metal.

For example, the metal powder 61 having the shape anisotropy or the metal powder 71 having the shape isotropy may be formed of an Fe—Si—Cr based amorphous metal, but is not limited thereto.

The metal powder 61 having the shape anisotropy and the metal powder 71 having the shape isotropy may be contained in a thermosetting resin in a form in which they are dispersed in the thermosetting resin.

The thermosetting resin may be, for example, an epoxy resin, a polyimide resin, or the like.

Figure 3A:
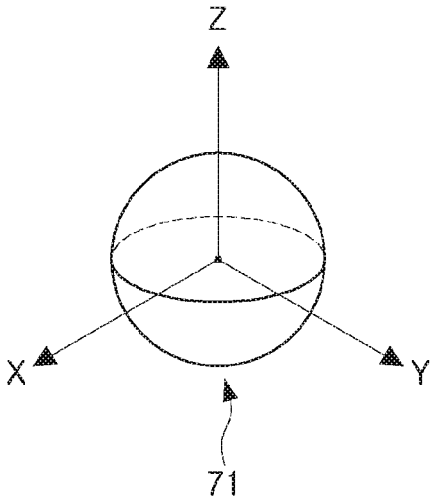
FIG. 3A is an enlarged perspective view of a metal powder having shape isotropy.
Figure 3B:
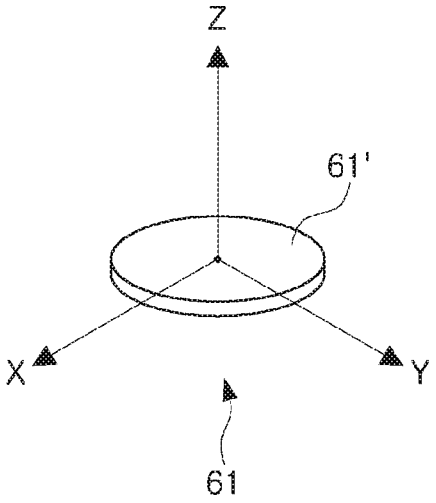
FIG. 3B is an enlarged perspective view of a metal powder having shape anisotropy.

FIG. 3A is an enlarged perspective view of a metal powder having shape isotropy, and FIG. 3B is an enlarged perspective view of a metal powder having shape anisotropy.

Referring to FIG. 3A, the metal powder 71 having the shape isotropy may be represented as a spherical shape. Shape isotropy means that the same property is shown in all of x, y, and z axis directions.

The metal powder 71 having the shape isotropy may exhibit the same magnetic permeability in all of the x, y, and z axis directions.

Conversely, the metal powder 61 having the shape anisotropy may have properties different from each other in the x, y, and z axis directions.

As illustrated in FIG. 3B, the metal powder 61 having the shape anisotropy may be, for example, a flake-shaped metal powder.

Generally, the metal powder 61 having the shape anisotropy may exhibit magnetic permeability higher than that of the metal powder 71 having the shape isotropy. Therefore, the coil electronic component has been manufactured using sheets containing the metal powder 61 having the shape anisotropy of which magnetic permeability is higher than that of the metal powder 71 having the shape isotropy in order to improve inductance (L).

However, since the magnetic permeability of the metal powder 61 having the shape anisotropy is changed in each direction, the entire magnetic permeability of the metal powder 61 having the shape anisotropy may be higher than that of the metal powder 71 having the shape isotropy, but magnetic permeability of the metal powder 61 having the shape anisotropy in a specific direction may be very low to impede flow of a magnetic flux generated by a current applied to the coil part.

For example, the metal powder 61 having the shape anisotropy illustrated in FIG. 3B may have high magnetic permeability in x and y axis directions on a flake-shaped surface 61', but may have very low magnetic permeability in a z axis direction perpendicular to the flake-shaped surface 61'. Therefore, the metal powder 61 having the shape anisotropy as described above may impede flow of the magnetic flux flowing in the z axis direction, and thus inductance (L) may be reduced.

Therefore, in an exemplary embodiment, as illustrated in FIG. 2, the dipping coating part 53 containing the metal powder 61 having the shape anisotropy may be formed, and the metal powder 61 having the shape anisotropy, contained in the dipping coating part 53, may be arranged so that one axis of the flake-shaped surfaces 61' thereof are directed toward a flow direction of the magnetic flux, thereby solving the above-mentioned problem.

Since the metal powder 61 having the shape anisotropy exhibits high magnetic permeability in one axis direction of the flake-shaped surfaces 61', the metal powder 61 having the shape anisotropy may be arranged so that one axis of the flake-shaped surfaces 61' is directed toward the flow direction of the magnetic flux, thereby making flow of the magnetic flux smooth and improving inductance (L) through high magnetic permeability. In addition, an excellent quality (Q) factor, excellent direct current (DC) bias characteristics, and the like, may be implemented by a high saturation magnetization value (Ms) of the metal powder 61 having the shape anisotropy.

The dipping coating part 53 may be formed by dipping the coil part 40 in a slurry containing the metal powder 61 having the shape anisotropy.

Conventionally, since the coil electronic component was manufactured using sheets containing the metal powder 61 having the shape anisotropy, there was a limitation in arranging the metal powder 61 having the shape anisotropy to be directed toward the flow direction of the magnetic flux. That is, in a case in which the coil electronic component is manufactured using sheets containing the metal powder 61 having the shape anisotropy, it was substantially difficult to arrange the metal powder 61 having the shape anisotropy to be directed toward the flow direction of the magnetic flux. In particular, in some regions in which a change in the flow direction of the magnetic flux is large, the metal powder 61 having the shape anisotropy was not arranged to be directed toward the flow direction of the magnetic flux, thereby impeding the flow of the magnetic flux.

Therefore, in an exemplary embodiment, the coil part 40 may be dipped in the slurry containing the metal powder 61 having the shape anisotropy to form the dipping coating part 53 in which the metal powder 61 having the shape anisotropy is arranged to be directed toward the flow direction of the magnetic flux.

Since the metal powder 61 having the shape anisotropy may be arranged to have more fluidity in a case in which the metal powder 61 having the shape anisotropy are contained in the slurry than in a case in which the metal powder 61 having the shape anisotropy are contained in the sheets, the metal powder 61 having the shape anisotropy may be arranged to be directed toward the flow direction of the magnetic flux.

Here, an insulating layer 30 covering the first and second coil conductors 41 and 42 may be formed on the first and second coil conductors 41 and 42 forming the coil part 40, and the dipping coating part 53 may be formed on the insulating layer 30.

The insulating layer 30 may contain a polymer material such as an epoxy resin, a polyimide resin, or the like, a photo-resist (PR), a metal oxide, and the like. However, a material of the insulating layer 30 is not limited thereto, and may be any insulating material that may enclose the first and second coil conductors 41 and 42 to prevent short circuits.

The metal powder 61 having the shape anisotropy, contained in the dipping coating part 53, may be arranged so that one axis of the flake-shaped surfaces 61' thereof are directed toward the flow direction of the magnetic flux.

For example, the metal powder 61 having the shape anisotropy, contained in the dipping coating part 53, may be arranged so that one axis of the flake-shaped surfaces 61' thereof are perpendicular to the thickness (t) direction of the coil part 40, on upper and lower portions of the coil part 40, and may be arranged so that one axis of the flake-shaped surfaces 61' thereof are in parallel with the thickness (t) direction of the coil part 40, on side portions of the coil part 40.

Therefore, a phenomenon that the flow of the magnetic flux is impeded by the metal powder 61 having the shape anisotropy may be prevented, and the flow of the magnetic flux may become smoother, thereby implementing higher inductance (L).

In particular, since the dipping coating part 53 is formed around the coil part 40 in which the magnetic flux is concentrated, the inductance (L) may be more effectively improved.

Figure 4:
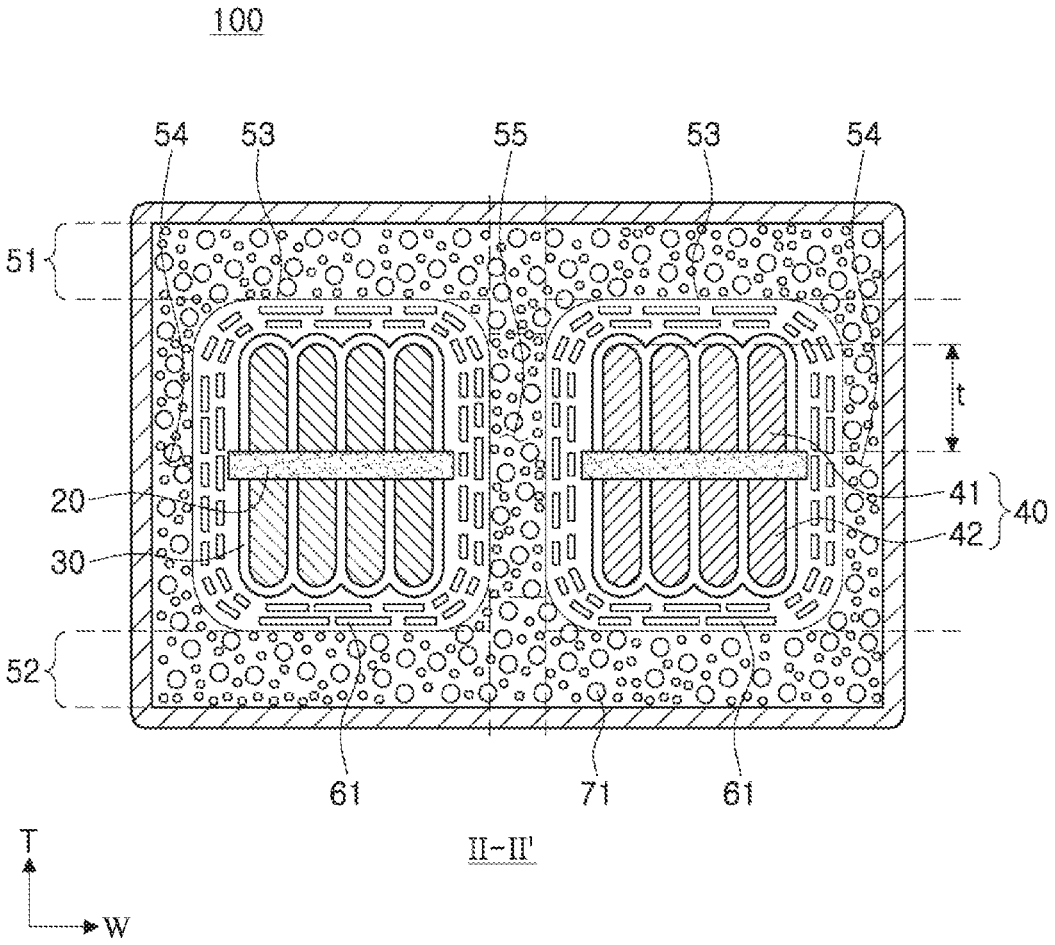
FIG. 4 is a cross-sectional view taken along line II-II' of FIG. 1.

FIG. 4 is a cross-sectional view taken along line II-II' of FIG. 1.

Referring to FIG. 4, in the coil electronic component 100 according to an exemplary embodiment, the dipping coating part 53 containing the metal powder 61 having the shape anisotropy may be formed around the coil part 40, and the metal powder 71 having the shape isotropy may be contained in the core part 55, the outer peripheral part 54, and the first and second cover parts 51 and 52. The core part 55 may be a layer containing the metal powder 71 having the shape isotropy, connecting the first and second cover parts 51 and 52 to each other, and penetrating a region enclosed by the coil part 40. The outer peripheral part 54 may be another layer containing the metal powder 71 having the shape isotropy, connecting the first and second cover parts 51 and 52 to each other, and disposed outside the coil part 40. The core part 55 and the outer peripheral part 54 each containing the metal powder 71 having the shape isotropy may confine the dipping coating layer 53 in a length-width plane. Although not shown in FIGS. 1, 2, and 4, the dipping coating part 53 may have a doughnut shape. Inner edge and outer edge of the doughnut shape may be respectively defined by the core part 55 and the outer peripheral part 54.

The coil electronic component according to the present exemplary embodiment may be formed by dipping the coil part 40 in the slurry containing the metal powder 61 having the shape anisotropy to form the dipping coating part 53 and then stacking and compressing magnetic sheets containing the metal powder 71 having the shape isotropy.

Figure 5:
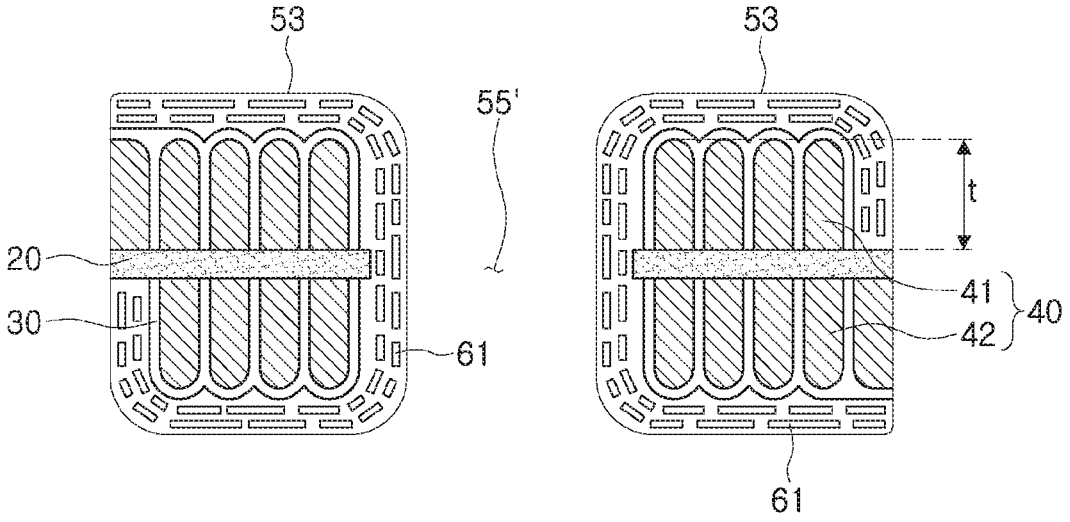
FIG. 5 is an enlarged cross-sectional view of a coil part around which a dipping coating part of the coil electronic component according to an exemplary embodiment in the present disclosure is formed.

FIG. 5 is an enlarged cross-sectional view of a coil part around which a dipping coating part of the coil electronic component according to an exemplary embodiment is formed.

Referring to FIG. 5, the insulating layer 30 covering the first and second coil conductors 41 and 42 may be formed on the first and second coil conductors 41 and 42 forming the coil part 40, and the dipping coating part 53 may be formed on the insulating layer 30.

The dipping coating part 53 may contain the metal powder 61 having the shape anisotropy. One axis of the flake-shaped surfaces 61' of the metal powder 61 having the shape anisotropy may be arranged in the flow direction of the magnetic flux.

That is, the metal powder 61 having the shape anisotropy, formed on the upper and lower portions of the coil part 40 among the metal powder 61 having the shape anisotropy, contained in the dipping coating part 53, may be arranged so that one axis of the flake-shaped surfaces 61' thereof is perpendicular to the thickness (t) direction of the coil part 40, and the metal powder 61 having the shape anisotropy, formed on the side portions of the coil part 40 among the metal powder 61 having the shape anisotropy, contained in the dipping coating part 53, may be arranged so that one axis of the flake-shaped surfaces 61' thereof is in parallel with the thickness (t) direction of the coil part 40.

FIGS. 6 through 9 are, respectively, cross-sectional views of coil electronic components according to other exemplary embodiments in a length-thickness (L-T) direction.

Figure 6:
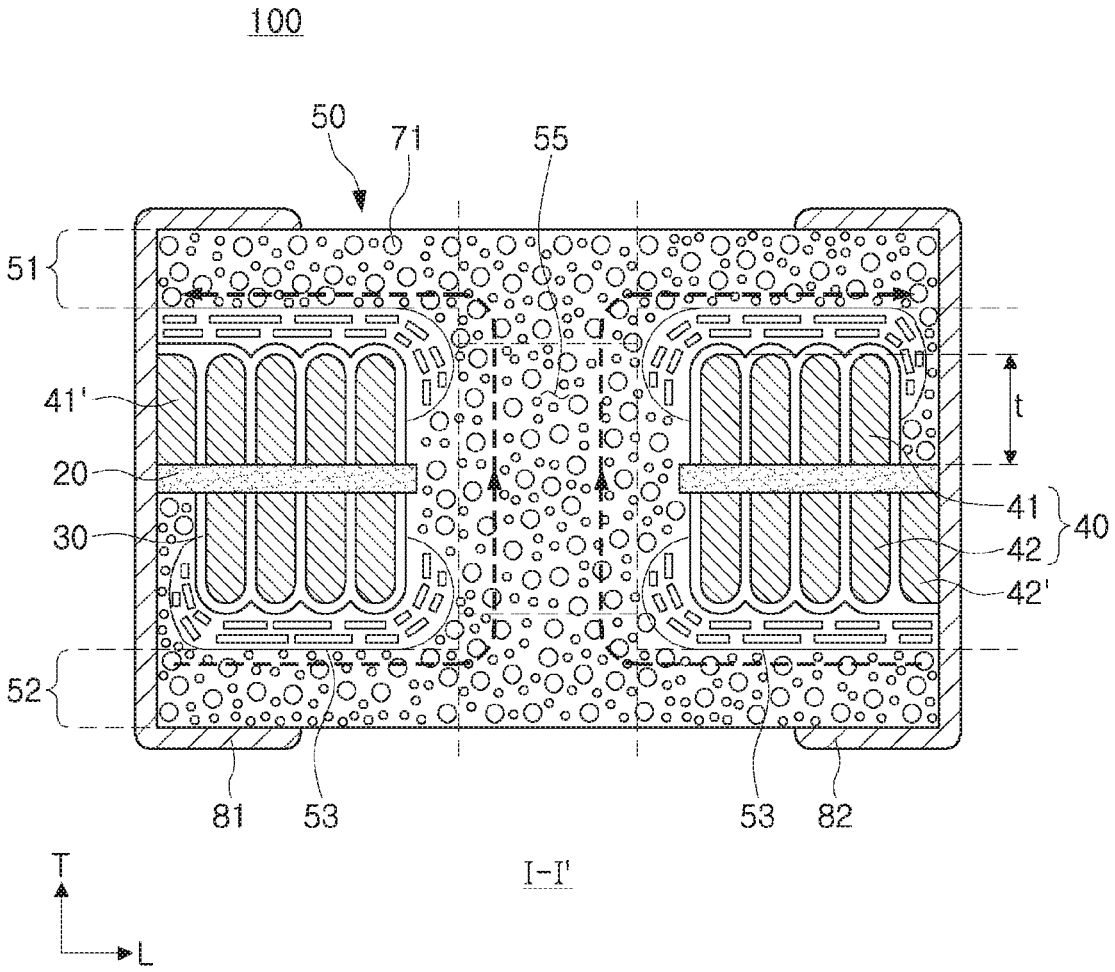
FIGS. 6 through 9 are, respectively, cross-sectional views of coil electronic components according to other exemplary embodiments in the present disclosure in a length-thickness (L-T) direction.

Referring to FIG. 6, in a coil electronic component 100 according to another exemplary embodiment, the dipping coating part 53 containing the metal powder 61 having the shape anisotropy may be formed on upper and lower portions of the coil part 40 and may be formed on portions of side portions extending from the upper and lower portions of the coil part 40.

That is, the dipping coating part 53 may be formed on the upper and lower portions of the coil part 40 and may be formed on the entirety of the side portions of the coil part 40 extending from the upper and lower portions of the coil part 40 in an exemplary embodiment illustrated in FIG. 2, while the dipping coating part 53 may be formed on the upper and lower portions of the coil part 40 and may be formed on portions of the side portions of the coil part 40 extending from the upper and lower portions of the coil part 40 in another exemplary embodiment illustrated in FIG. 6.

When the coil part 40 is dipped in the slurry containing the metal powder 61 having the shape anisotropy, a level at which the coil part 40 is dipped in the slurry, that is, a depth at which the coil part 40 is dipped in the slurry may be adjusted to change a shape of the dipping coating part 53.

The metal powder 61 having the shape anisotropy, contained in the dipping coating part 53 of the coil electronic component 100 according to another exemplary embodiment illustrated in FIG. 6, may also be arranged so that one axis of the flake-shaped surfaces 61' thereof is directed toward the flow direction of the magnetic flux, as described above.

The coil electronic component according to another exemplary embodiment illustrated in FIG. 6 may have the same configuration as that of the coil electronic component 100 according to the exemplary embodiment described above except that the dipping coating part 53 is formed on portions of the side portions of the coil part 40.

Figure 7:
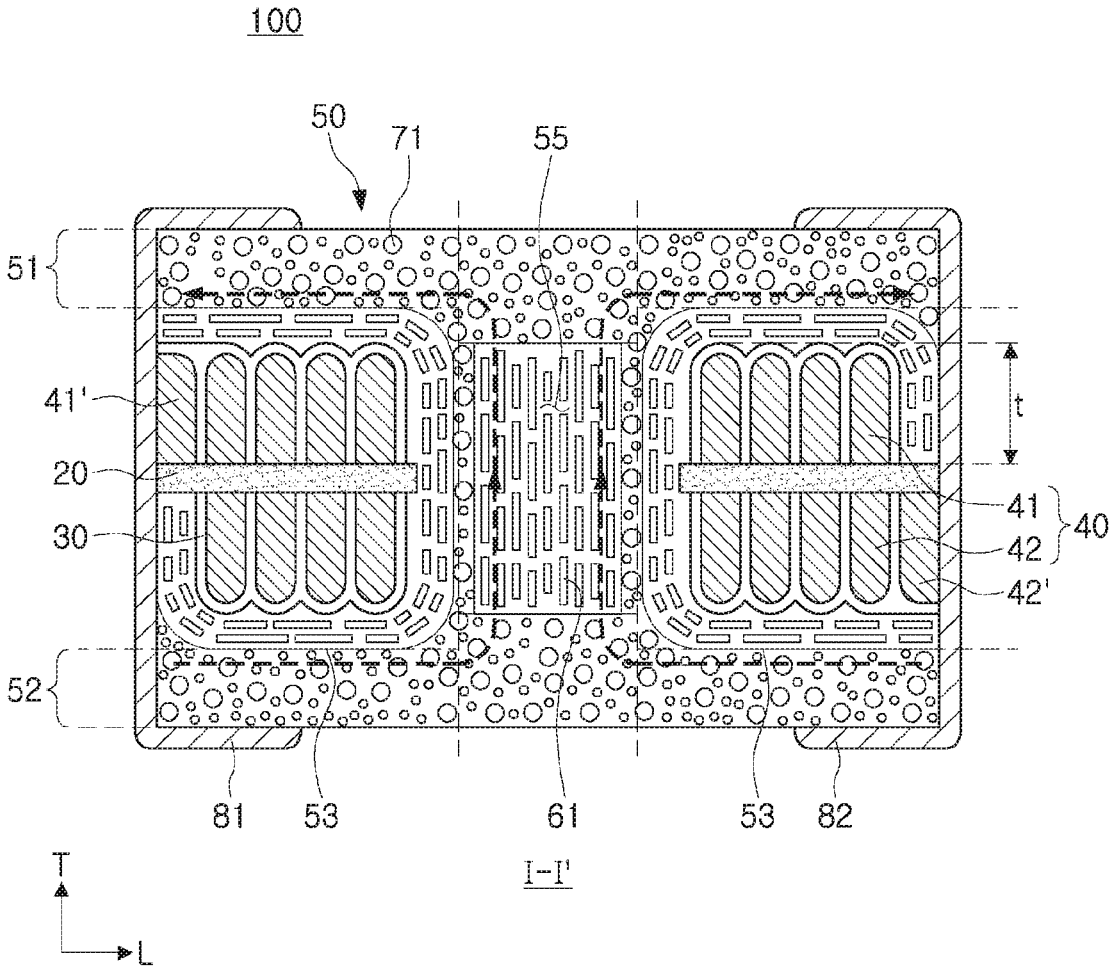

Referring to FIG. 7, in a coil electronic component 100 according to another exemplary embodiment, the dipping coating part 53 containing the metal powder 61 having the shape anisotropy may be formed around the coil part 40, and the metal powder 61 having the shape anisotropy may be further contained in the core part 55.

The metal powder 61 having the shape anisotropy, contained in the core part 55, may be arranged so that one axis of the flake-shaped surfaces 61' thereof is in parallel with the thickness (t) direction of the coil part 40 to be directed toward the flow direction of the magnetic flux. Therefore, inductance (L) may be further improved through high magnetic permeability of the metal powder 61 having the shape anisotropy, formed in the core part 55, as compared to a case in which the metal powder 71 having the shape isotropy are contained in the core part 55 according to an exemplary embodiment illustrated in FIG. 2.

Meanwhile, although not illustrated in FIG. 7, the outer peripheral part 54 may also contain the metal powder 61 having the shape anisotropy, arranged so that one axis of the flake-shaped surfaces 61' thereof is in parallel with the thickness (t) direction of the coil part 40 to be directed toward the flow direction of the magnetic flux, similar to the core part 55. Although not illustrated in FIG. 7, the outer peripheral part 54 may also include a layer containing the metal powder 71 having the shape isotropy, connecting the first and second cover parts 51 and 52 to each other, and disposed outside the coil part 40.

The coil electronic component according to the present exemplary embodiment may be formed by dipping the coil part 40 in the slurry containing the metal powder 61 having the shape anisotropy to form the dipping coating part 53, disposing magnetic sheets containing the metal powder 61 having the shape anisotropy in the core part 55 and/or the outer peripheral part 53, and then stacking and compressing magnetic sheets containing the metal powder 71 having the shape isotropy.

The coil electronic component according to another exemplary embodiment illustrated in FIG. 7 may have the same configuration as that of the coil electronic component 100 according to the exemplary embodiment described above except that the metal powder 61 having the shape anisotropy is formed in the core part 55. The core part 55 may also include a layer containing the metal powder 71 having the shape isotropy, connecting the first and second cover parts 51 and 52 to each other, and penetrating a region enclosed by the coil part 40.

Figure 8:
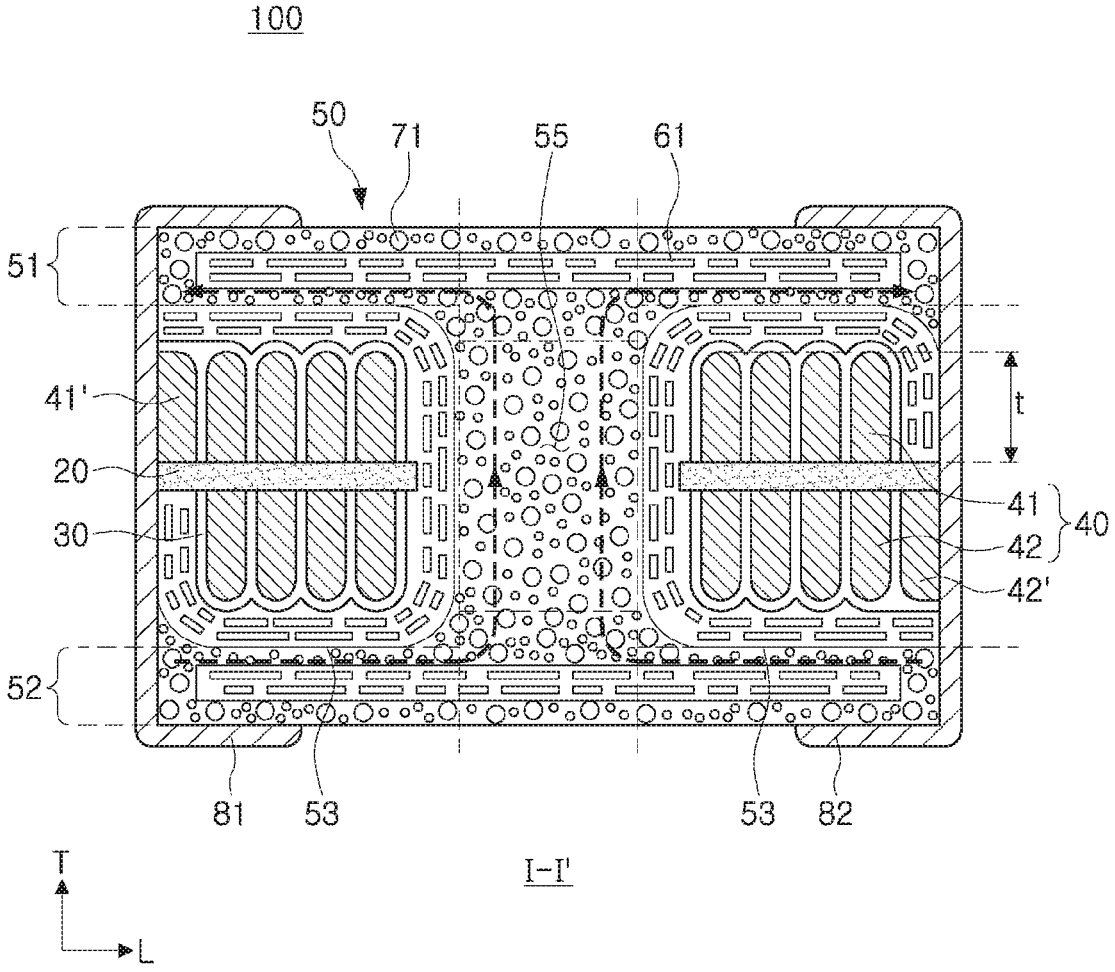

Referring to FIG. 8, in a coil electronic component 100 according to another exemplary embodiment, the dipping coating part 53 containing the metal powder 61 having the shape anisotropy may be formed around the coil part 40, and the metal powder 61 having the shape anisotropy may be further contained in the first and second cover parts 51 and 52.

The metal powder 61 having the shape anisotropy, contained in the first and second cover parts 51 and 52, may be arranged so that one axis of the flake-shaped surfaces 61' thereof is perpendicular to the thickness (t) direction of the coil part 40 to be directed toward the flow direction of the magnetic flux. Therefore, inductance (L) may be further improved through high magnetic permeability of the metal powder 61 having the shape anisotropy, formed in the first and second cover parts 51 and 52, as compared with a case in which the metal powder 71 having the shape isotropy is contained in the first and second cover parts 51 and 52 according to an exemplary embodiment illustrated in FIG. 2.

The coil electronic component according to the present exemplary embodiment may be formed by dipping the coil part 40 in the slurry containing the metal powder 61 having the shape anisotropy to form the dipping coating part 53, stacking and compressing magnetic sheets containing the metal powder 71 having the shape isotropy to form the core part 55, disposing magnetic sheets containing the metal powder 61 having the shape anisotropy in the first and second cover parts 51 and 52, and then again stacking and compressing magnetic sheets containing the metal powder 71 having the shape isotropy.

The coil electronic component according to another exemplary embodiment illustrated in FIG. 8 may have the same configuration as that of the coil electronic component 100 according to the exemplary embodiment described above except that the metal powder 61 having the shape anisotropy is formed in the first and second cover parts 51 and 52.

Figure 9:
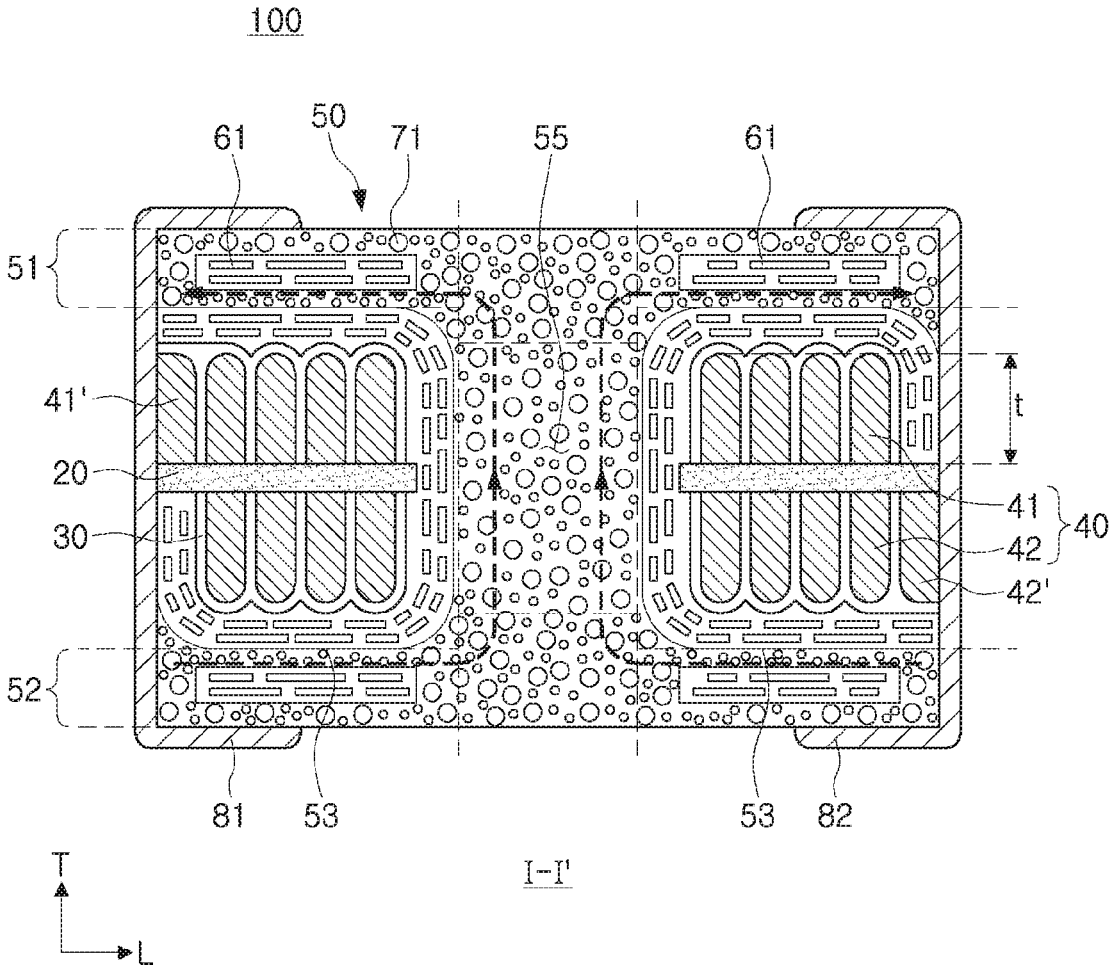

Referring to FIG. 9, in a coil electronic component 100 according to another exemplary embodiment, the dipping coating part 53 containing the metal powder 61 having the shape anisotropy may be formed around the coil part 40, the metal powder 61 having the shape anisotropy, disposed so that one axis of the flake-shaped surfaces 61' thereof is directed toward the flow direction of the magnetic flux may be contained in portions of the first and second cover parts 51 and 52, and the metal powder 71 having the shape isotropy may be contained in regions above and below the core part 55 in which a change in the flow direction of the magnetic flux is large.

In a case in which the metal powder 61 having the shape anisotropy is arranged on the entirety of the cover parts so that one axis of the flake-shaped surfaces 61' thereof is perpendicular to the thickness (t) direction of the coil part 40, as illustrated in FIG. 8, the metal powder 61 having the shape anisotropy, contained in the regions of the cover parts above and below the core part 55, may impede the flow of the magnetic flux.

Therefore, in the coil electronic component 100 according to another exemplary embodiment illustrated in FIG. 9, the metal powder 61 having the shape anisotropy is not contained in the entirety of the first and second cover parts 51 and 52, but may be arranged in portions of the first and second cover parts 51 and 52 so that one axis of the flake-shaped surfaces 61' thereof is perpendicular to the thickness (t) direction of the coil part 40 to be directed toward the flow direction of the magnetic flux, and the metal powder 71 having the shape isotropy may be contained in the regions above and below the core part 55 in which the change in the flow direction of the magnetic flux is large.

Therefore, a phenomenon that the flow of the magnetic flux is impeded by the metal powder 61 having the shape anisotropy in the regions above and below the core part 55 may be prevented, and the flow of the magnetic flux may become smoother, thereby implementing higher inductance (L).

The coil electronic component according to the present exemplary embodiment may be formed by dipping the coil part 40 in the slurry containing the metal powder 61 having the shape anisotropy to form the dipping coating part 53, stacking and compressing magnetic sheets containing the metal powder 71 having the shape isotropy to form the core part 55, disposing magnetic sheets containing the metal powder 61 having the shape anisotropy and having a doughnut shape in the first and second cover parts 51 and 52, and then again stacking and compressing magnetic sheets containing the metal powder 71 having the shape isotropy.

The coil electronic component according to another exemplary embodiment illustrated in FIG. 9 may have the same configuration as that of the coil electronic component 100 according to the exemplary embodiment described above except that the metal powder 61 having the shape anisotropy is formed in regions of the first and second cover parts 51 and 52 corresponding to the coil part 40.

Figure 10:
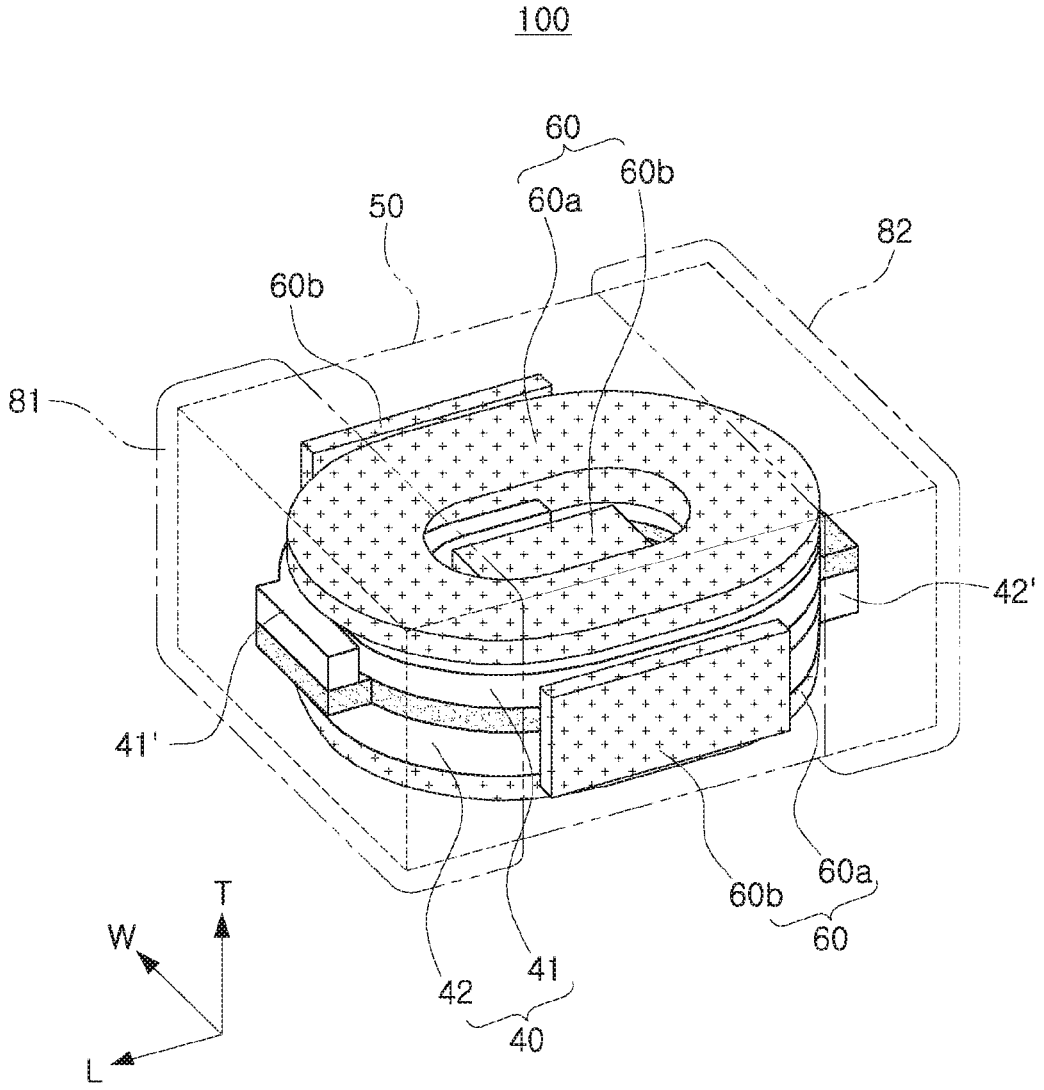
FIG. 10 is a perspective view illustrating a coil electronic component according to another exemplary embodiment in the present disclosure so that a coil part of the coil electronic component and magnetic sheets containing metal powders having shape anisotropy are visible.

FIG. 10 is a perspective view illustrating a coil electronic component according to another exemplary embodiment in the present disclosure so that a coil part of the coil electronic component and magnetic sheets containing metal powder having shape anisotropy are visible.

Referring to FIG. 10, in a coil electronic component 100 according to another exemplary embodiment, magnetic sheets 60 containing the metal powder 61 having the shape anisotropy may be disposed around the coil part 40 (the dipping coating part 53 formed around the coil part 40 is not illustrated in FIG. 10).

As illustrated in FIG. 10, magnetic sheets **60*a* containing the metal powder 61 having the shape anisotropy and having a doughnut shape may be disposed on upper and lower portions of the coil part 40 to allow the metal powder 61 having the shape anisotropy to be contained in regions of the first and second cover parts 51 and 52 corresponding to the coil part 40**.

The metal powder 61 having the shape anisotropy, contained in the magnetic sheets **60*a* having the doughnut shape, may be arranged so that one axis of the flake-shaped surfaces 61' thereof is perpendicular to the thickness (t) direction of the coil part 40**.

In addition, magnetic sheets **60*b* containing the metal powder 61 having the shape anisotropy may be disposed in the core part 55 formed inside the coil part 40 and the outer peripheral part 54 formed outside the coil part 40 to allow the metal powder 61 having the shape anisotropy to be contained in the core part 55 and the outer peripheral part 54. Although not labeled in FIG. 10, the core part 55 may include a layer containing the metal powder 71 having the shape isotropy, connecting the first and second cover parts 51 and 52 to each other, and penetrating a region enclosed by the coil part 40. The outer peripheral part 54 may include another layer containing the metal powder 71 having the shape isotropy, connecting the first and second cover parts 51 and 52 to each other, and disposed outside the coil part 40. The core part 55 and the outer peripheral part 54 each containing the metal powder 71 having the shape isotropy may confine the dipping coating layer 53 in a length-width plane. Inner edge and outer edge of the doughnut shape may be respectively defined by the core part 55 and the outer peripheral part 54**.

The metal powder 61 having the shape anisotropy, contained in the magnetic sheets 60*b* disposed in the core part 55, and the outer peripheral part 54 may be arranged so that one axis of the flake-shaped surfaces 61' thereof is in parallel with the thickness (t) direction of the coil part 40.

The coil part 40 may be dipped in the slurry containing the metal powder 61 having the shape anisotropy to form the dipping coating part 53 (not illustrated in FIG. 10), the magnetic sheets 60 containing the metal powder 61 having the shape anisotropy may be disposed, and the remaining portion may be filled with magnetic sheets 70 containing the metal powder 71 having the shape isotropy, thereby forming the magnetic body 50 enclosing the coil part 40.

When the magnetic sheets 60*a* containing the metal powder 61 having the shape anisotropy and having the doughnut shape are disposed on the upper and lower portions of the coil part 40, regions of the first and second cover parts 51 and 52 above and below the core part 55 may be filled with the metal powder 71 having the shape isotropy.

Although a case in which structures of the coil electronic components 100 according to the respective other exemplary embodiments described above are implemented by forming the magnetic sheets 60 containing the metal powder 61 having the shape anisotropy and having a specific shape has been illustrated in FIG. 10, the coil electronic components 100 according to the respective other exemplary embodiments are not limited thereto. That is, any method that may implement the structures of the coil electronic components 100 according to the respective other exemplary embodiments described above may be used.

Method of Manufacturing Coil Electronic Component

Figure 11A:
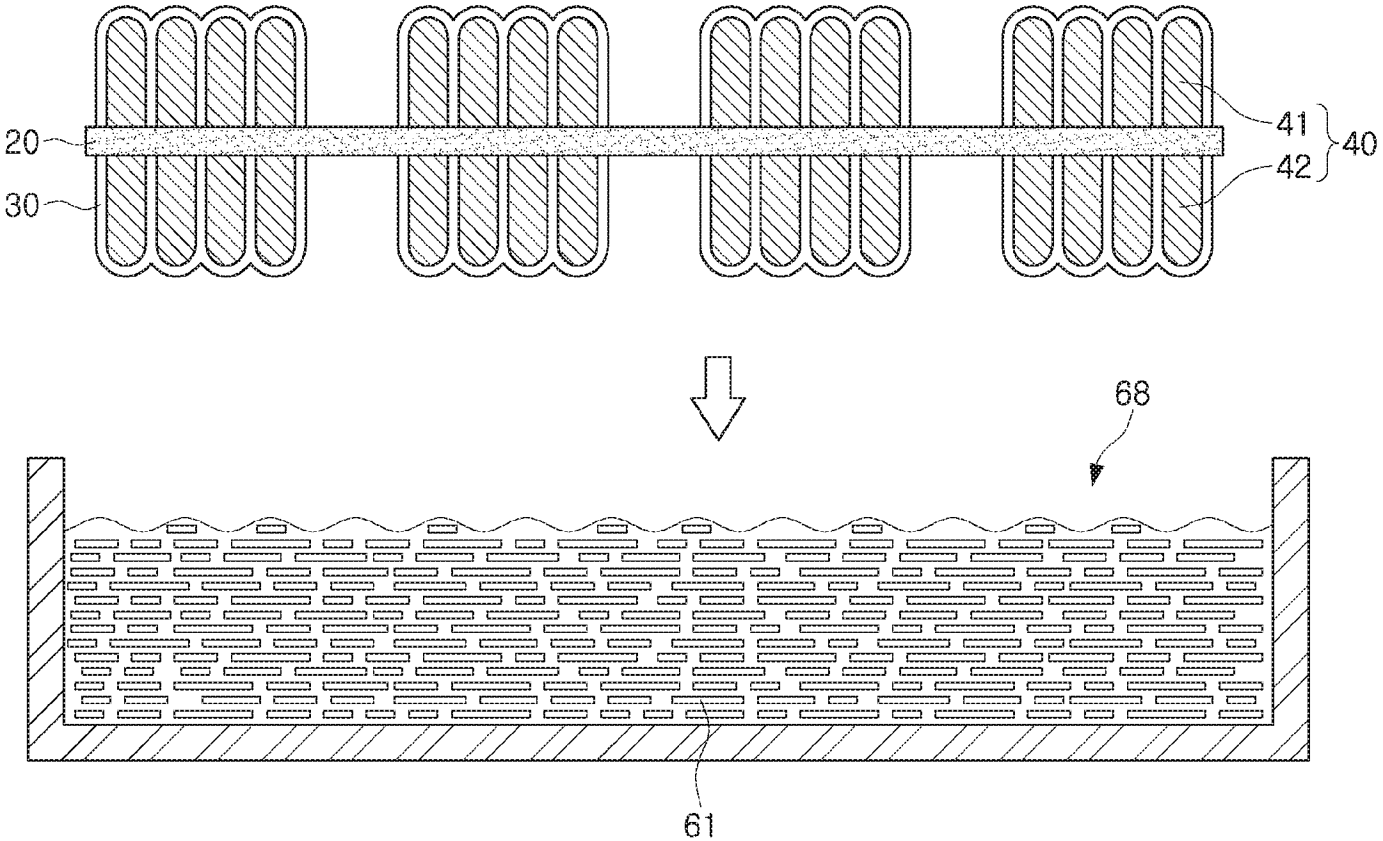
FIGS. 11A through 11C are views sequentially illustrating a method of manufacturing a coil electronic component according to an exemplary embodiment in the present disclosure.
Figure 11B:
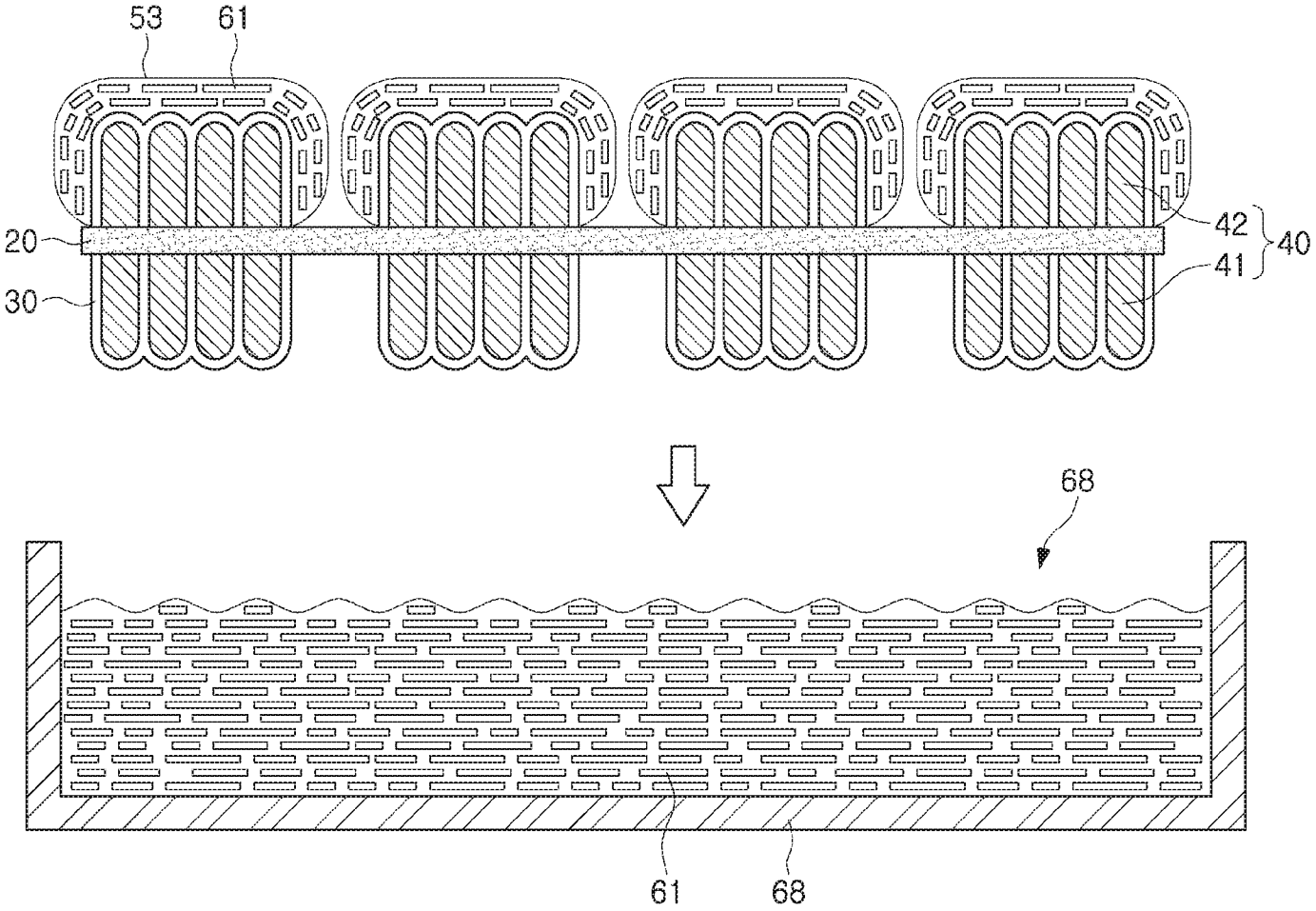
Figure 11C:
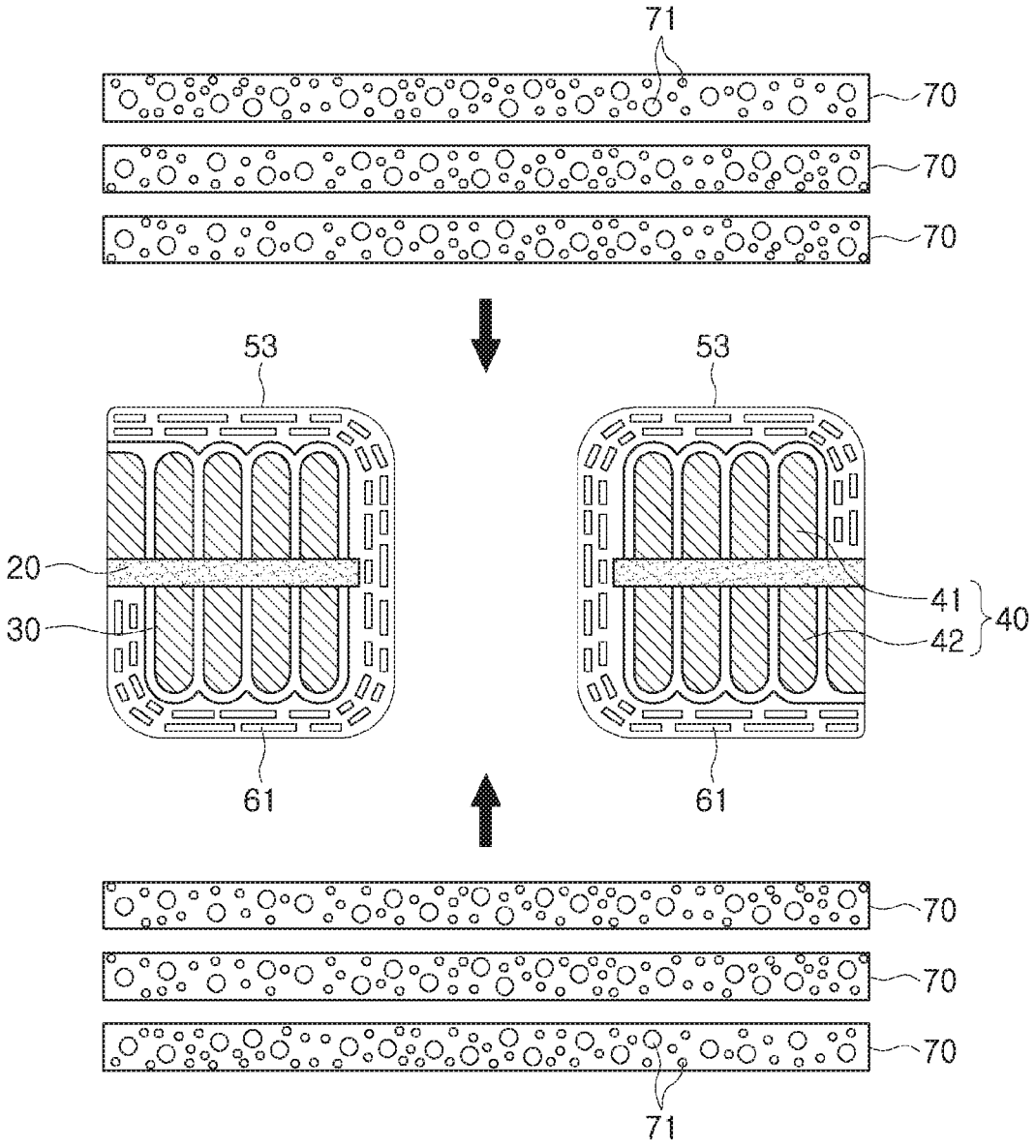

FIGS. 11A through 11C are views sequentially illustrating a method of manufacturing a coil electronic component according to an exemplary embodiment in the present disclosure.

Referring to FIG. 11*a*, the coil parts 40 may be formed on both surfaces of the support part 20, and the coil part 40 may be dipped in a slurry 68 containing the metal powder 61 having the shape anisotropy to form the dipping coating part 53 at one side of the coil part.

First, a via hole (not illustrated) may be formed in the support part 20, a plating resist (not illustrated) having an opening may be formed on the support part 20, and the via hole and the opening may be filled with a conductive metal by plating to form the first and second coil conductors 41 and 42 forming the coil part 40 and a via (not illustrated) connecting the first and second coil conductors 41 and 42 to each other.

The first and second coil conductors 41 and 42 and the via may be formed of a conductive metal having excellent electrical conductivity, such as silver (Ag), palladium (Pd), aluminum (Al), nickel (Ni), titanium (Ti), gold (Au), copper (Cu), platinum (Pt), or alloys thereof.

However, a method of forming the coil part 40 is not limited to the above-mentioned plating. For example, the coil part 40 may be formed of a metal wire or may be formed of any material that may generate magnetic flux by a current applied thereto.

The insulating layer 30 covering the first and second coil conductors 41 and 42 may be formed on the first and second coil conductors 41 and 42 forming the coil part 40.

The insulating layer 30 may contain a polymer material such as an epoxy resin, a polyimide resin, or the like, a photo-resist (PR), a metal oxide, and the like. However, a material of the insulating layer 30 is not limited thereto, and may be any insulating material that may enclose the first and second coil conductors 41 and 42 to prevent a short circuits.

The insulating layer 30 may be formed by a method such as a screen printing method, an exposure and development method of the photo-resist (PR), a spray applying method, an oxidation method through chemical etching of the coil conductors, or the like.

The dipping coating part 53 may be formed on the insulating layer 30 enclosing the first and second coil conductors 41 and 42 forming the coil part 40.

The slurry forming the dipping coating part 53 may be prepared by mixing the metal powder 61 having the shape anisotropy, a thermosetting resin, and organic materials such as a binder, a solvent, and the like, with each other.

Conventionally, since the coil electronic component was manufactured using the sheets containing the metal powder 61 having the shape anisotropy, there was a limitation in arranging the metal powder 61 having the shape anisotropy to be directed toward the flow direction of the magnetic flux. That is, in a case in which the coil electronic component is manufactured using the sheets containing the metal powder 61 having the shape anisotropy, it was substantially difficult to arrange the metal powder 61 having the shape anisotropy to be directed toward the flow direction of the magnetic flux. In particular, in some regions in which a change in the flow direction of the magnetic flux is large, the metal powder 61 having the shape anisotropy was not arranged to be directed toward the flow direction of the magnetic flux, thereby impeding the flow of the magnetic flux.

Therefore, in an exemplary embodiment, the coil part 40 may be dipped in the slurry containing the metal powder 61 having the shape anisotropy to form the dipping coating part 53 in which the metal powder 61 having the shape anisotropy is arranged to be directed toward the flow direction of the magnetic flux.

Since the metal powder 61 having the shape anisotropy may be arranged to have more fluidity in a case in which the metal powder 61 having the shape anisotropy is contained in the slurry than in a case in which the metal powder 61 having the shape anisotropy is contained in the sheets, the metal powder 61 having the shape anisotropy may be arranged to be directed toward the flow direction of the magnetic flux.

The metal powder 61 having the shape anisotropy, contained in the dipping coating part 53, may be arranged so that one axis of the flake-shaped surfaces 61' thereof is directed toward the flow direction of the magnetic flux.

For example, the metal powder 61 having the shape anisotropy, contained in the dipping coating part 53, may be arranged so that one axis of the flake-shaped surfaces 61' thereof is perpendicular to the thickness (t) direction of the coil part 40 at upper and lower portions of the coil part 40, and may be arranged so that one axis of the flake-shaped surfaces 61' thereof is in parallel with the thickness (t) direction of the coil part 40 at side portions of the coil part 40.

Therefore, a phenomenon that the flow of the magnetic flux is impeded by the metal powder 61 having the shape anisotropy may be prevented, and the flow of the magnetic flux may become smoother, thereby implementing higher inductance (L).

In particular, since the dipping coating part 53 is formed around the coil part 40 in which the magnetic flux is concentrated, inductance (L) may be more effectively improved.

Referring to FIG. 11B, after the dipping coil part 53 is formed at one side of the coil part 40, the other side of the coil part 40 may be dipped in a slurry 68 containing the metal powder 61 having the shape anisotropy to form the dipping coating part 53 at the other side of the coil part.

As described above, both sides of the coil part 40 may be alternately and repeatedly dipped in the slurry containing the metal powder 61 having the shape anisotropy to form the dipping coating part 53. After both sides of the coil part 40 are dipped in the slurry, drying, compressing, and hardening may be performed on both sides of the coil part 40 dipped in the slurry.

The dipping coating part 53 may have a form in which the metal powder 61 having the shape anisotropy is dispersed in a thermosetting resin.

The thermosetting resin may be, for example, an epoxy resin, a polyimide resin, or the like.

When the coil part 40 is dipped in the slurry containing the metal powder 61 having the shape anisotropy, a level at which the coil part 40 is dipped in the slurry, that is, a depth at which the coil part 40 is dipped in the slurry may be adjusted to change a shape of the dipping coating part 53.

For example, the coil part 40 may be dipped deeply in the slurry, thereby allowing the dipping coating part 53 to be formed on the upper and lower portions of the coil part 40 and on the entirety of the side portions of the coil part 40 extending from the upper and lower portions of the coil part 40. Alternatively, the coil part 40 may be dipped shallowly in the slurry, thereby allowing the dipping coating part 53 to be formed on the upper and lower portions of the coil part 40 and on portions of the side portions of the coil part 40 extending from the upper and lower portions of the coil part 40.

Next, referring to FIG. 11C, after the dipping coating part 53 is formed, the magnetic sheets 70 may be stacked and compressed above and below the coil part 40, thereby forming the magnetic body 50 including the core part 55 formed inside the coil part 40, the outer peripheral part 54 formed outside the coil part 40, and the first and second cover parts 51 and 52 formed above and below the coil part 40.

A core part hole 55' may be formed by removing a central portion of the support part 20 on which the first and second coil conductors 41 and 42 are not formed.

The support part 20 may be removed by a mechanical drill, a laser drill, sand blasting, punching, or the like.

The magnetic sheets 70 may be provided in the core part hole 55', thereby forming the core part 55.

The magnetic sheets 70 may be manufactured in a sheet shape by mixing the metal powder 71 having the shape isotropy, a thermosetting resin, and organic materials such as a binder, a solvent, and the like, with each other to prepare a slurry and applying and then drying the slurry at a thickness of several tens of micrometers on carrier films by a doctor blade method.

The magnetic sheets 70 may be manufactured in a form in which the metal powder 71 having the shape isotropy is dispersed in a thermosetting resin such as an epoxy resin, a polyimide resin, or the like.

The magnetic sheets 70 may be stacked, compressed, and hardened, thereby manufacturing the coil electronic component 100 according to an exemplary embodiment in which the metal powder 71 having the shape isotropy may be contained in the core part 55, the outer peripheral part 54, and the first and second cover parts 51 and 52.

Figure 11D:
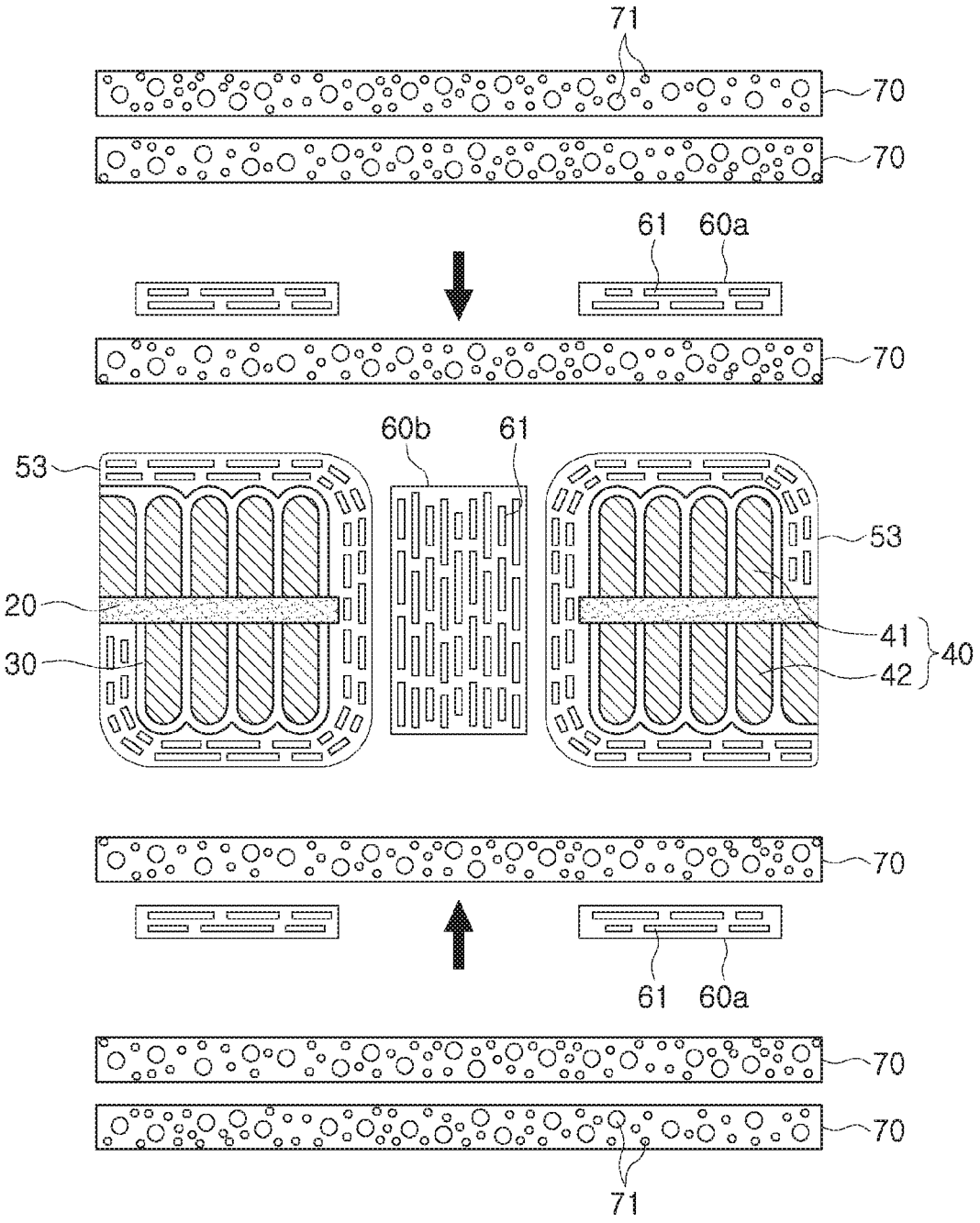
FIG. 11D is a view illustrating a process of manufacturing a coil electronic component according to another exemplary embodiment in the present disclosure.

Meanwhile, FIG. 11D is a view illustrating a process of manufacturing a coil electronic component according to another exemplary embodiment in the present disclosure.

Referring to FIG. 11D, after the dipping coating part 53 is formed, the magnetic sheets 60*a* and 60*b* containing the metal powder 61 having the shape anisotropy may be disposed around the coil part 40 around which the dipping coating part 53 is formed.

The magnetic sheets 60*a* and 60*b* may be manufactured in a sheet shape by mixing the metal powder 61 having the shape anisotropy, a thermosetting resin, and organic materials such as a binder, a solvent, and the like, with each other to prepare a slurry and applying and then drying the slurry on carrier films by a doctor blade method.

The magnetic sheets 60*a* and 60*b* may be manufactured in a form in which the metal powder 61 having the shape anisotropy is dispersed in a thermosetting resin such as an epoxy resin, a polyimide resin, or the like.

As illustrated in FIG. 11D, the magnetic sheets 60*a* containing the metal powder 61 having the shape anisotropy and having the doughnut shape may be disposed above and below the coil part 40 to allow the metal powder 61 having the shape anisotropy to be contained in only the regions of the first and second cover parts 51 and 52 corresponding to the coil part 40.

The metal powder 61 having the shape anisotropy, contained in the magnetic sheets 60*a* having the doughnut shape, may be arranged so that one axis of the flake-shaped surfaces 61' thereof is perpendicular to the thickness (t) direction of the coil part 40.

In addition, the magnetic sheets 60*b* containing the metal powder 61 having the shape anisotropy may be disposed in the core part hole 55' formed inside the coil part 40 to allow the metal powder 61 having the shape anisotropy to be contained in the core part 55.

Although not illustrated in FIG. 11D, the magnetic sheets 60*b* containing the metal powder 61 having the shape anisotropy may also be disposed in an outer peripheral part hole formed outside the coil part 40 to allow the metal powder 61 having the shape anisotropy to be contained in the outer peripheral part 54.

The metal powder 61 having the shape anisotropy, contained in the magnetic sheets 60*b* disposed in the core part 55, and the outer peripheral part 54 may be arranged so that one axis of the flake-shaped surfaces 61' thereof is in parallel with the thickness (t) direction of the coil part 40.

Meanwhile, although a case in which the coil electronic component 100 according to the exemplary embodiment described above is manufactured by disposing the magnetic sheets 60*a* and 60*b* containing the metal powder 61 having the shape anisotropy and having a specific shape in the regions of the first and second cover parts 51 and 52 corresponding to the coil part 40 and the core part hole 55' has been illustrated in FIG. 11D, the coil electronic component 100 according to the exemplary embodiment described above is not limited thereto, and may be manufactured by any method that may implement a structure of the coil electronic component 100 according to the exemplary embodiment described above.

Next, the magnetic sheets 70 containing the metal powder 71 having the shape isotropy may be stacked, compressed, and hardened above and below the coil part 40, thereby forming the magnetic body 50.

The magnetic sheets 70 containing the metal powder 71 having the shape isotropy may be stacked, compressed, and hardened above and below the coil part 40, thereby filling portions other than portions in which the magnetic sheets 60 containing the metal powder 61 having the shape anisotropy are disposed with the metal powder 71 having the shape isotropy.

As illustrated in FIG. 11D, when the magnetic sheets 70 containing the metal powder 71 having the shape isotropy are formed after the magnetic sheets 60*a* containing the metal powder 61 having the shape anisotropy and having the doughnut shape are disposed above and below the coil part 40, the regions of the first and second cover parts 51 and 52 above and below the core part 55 may be filled with the metal powder 71 having the shape isotropy.

Meanwhile, although a process of forming the dipping coating part 53 around the coil part 40 and then stacking the magnetic sheets 60 containing the metal powder 61 having the shape anisotropy and the magnetic sheets 70 containing the metal powder 71 having the shape isotropy has been described as a method of manufacturing a coil electronic component according to another exemplary embodiment, a method of manufacturing a coil electronic component is not limited thereto, and may be any method that may form a metal powder-resin composite of a structure of the coil electronic component 100 according to an exemplary embodiment.

Next, the first and second external electrodes 81 and 82 may be formed on the outer surfaces of the magnetic body 50 to be connected to the coil part 40.

A description of features overlapping those of the coil electronic component according to the exemplary embodiment described above except for the above-mentioned description will be omitted.

As set forth above, according to an exemplary embodiment, high magnetic permeability may be implemented, thereby improving inductance (L).

While exemplary embodiments have been shown and described above, it will be apparent to those skilled in the art that modifications and variations could be made without departing from the scope of the present invention as defined by the appended claims.

What is claimed is:

1. A coil electronic component comprising:

a coil part disposed on both surfaces of a support part; and a magnetic body enclosing the support part and the coil part, the magnetic body comprising:

a first magnetic part comprising a magnetic powder having shape anisotropy, the first magnetic part conformally surrounding the coil part, and a second magnetic part comprising a magnetic powder having shape isotropy, the second magnetic part surrounding the first magnetic part, wherein the second magnetic part is entirely spaced apart from the coil part by the first magnetic part.

2. The coil electronic component of claim 1, wherein the first magnetic part is formed by dipping the coil part in a slurry comprising the metal powder having the shape anisotropy.

3. The coil electronic component of claim 1, wherein the metal powder having the shape anisotropy is arranged so that one axis of flake-shaped surfaces thereof is directed toward a flow direction of a magnetic flux generated by the coil part.

4. The coil electronic component of claim 1, wherein the first magnetic part is disposed on upper and lower portions of the coil part and is disposed on portions or an entirety of side portions of the coil part extending from the upper and lower portions of the coil part.

5. The coil electronic component of claim 4, wherein the metal powder having the shape anisotropy, contained in the first magnetic part, is arranged so that one axis of flake-shaped surfaces thereof is perpendicular to a thickness direction of the coil part, on the upper and lower portions of the coil parts, and is arranged so that one axis of the flake-shaped surfaces thereof is in parallel with the thickness direction of the coil parts, on the side portions of the coil parts.

6. The coil electronic component of claim 1, wherein the metal powder having the shape anisotropy comprises one or more selected from the group consisting of iron (Fe), silicon (Si), boron (B), chrome (Cr), aluminum (Al), copper (Cu), niobium (Nb), and nickel (Ni), or alloys thereof.

7. The coil electronic component of claim 1, wherein the metal powder having the shape anisotropy is dispersed and contained in a thermosetting resin.

8. The coil electronic component of claim 1, wherein the second magnetic part comprises a core part disposed inside the coil part, an outer peripheral part disposed outside the coil part, and first and second cover parts disposed above and below the coil part, each of the core part, the outer peripheral part, the first cover part and the second cover part comprising metal powder having shape isotropy.

9. The coil electronic component of claim 8, wherein the core part and the outer peripheral part each comprising the metal powder having the shape isotropy confine the first magnetic part in a length-width plane.

10. The coil electronic component of claim 1, comprising a first layer comprising metal powder having shape isotropy, connecting the first and second cover parts to each other, and penetrating a region enclosed by the coil part.

11. The coil electronic component of claim 1, comprising a second layer comprising metal powder having shape isotropy, connecting the first and second cover parts to each other, and disposed outside the coil part.

12. The coil electronic component of claim 1, wherein the first magnetic part has a doughnut shape.

13. The coil electronic component of claim 8, wherein at least one of the core part and the outer peripheral part comprises metal powder having shape anisotropy, and the metal powder having the shape anisotropy, contained in at least one of the core part and the outer peripheral part, is arranged so that one axis of flake-shaped surfaces thereof is in parallel with a thickness direction of the coil part.

14. The coil electronic component of claim 8, wherein at least one of the first and second cover parts comprises metal powder having shape anisotropy, and the metal powder having the shape anisotropy, contained in at least one of the first and second cover parts, is arranged so that one axis of flake-shaped surfaces thereof is perpendicular to a thickness direction of the coil part.

15. The coil electronic component of claim 14, wherein in the first and second cover parts, the metal powder having the shape anisotropy is contained only in regions of the first and second cover parts corresponding to the coil part.

16. The coil electronic component of claim 1, wherein the coil part includes a first coil conductor disposed on an upper surface of the support part and a second coil conductor disposed on a lower surface of the support part.

17. A coil electronic component comprising:

a coil part; and a magnetic body enclosing the coil part, the magnetic body comprising:

a first magnetic part comprising a magnetic powder having shape anisotropy, the first magnetic part conformally surrounding the coil part, and a second magnetic part comprising a magnetic powder having shape isotropy, the second magnetic part surrounding the first magnetic part, wherein the second magnetic part is entirely spaced apart from the coil part by the first magnetic part.

18. The coil electronic component of claim 17, wherein the metal powder having the shape anisotropy is arranged so that one axis of flake-shaped surfaces thereof is directed toward a flow direction of a magnetic flux generated by the coil part.

19. The coil electronic component of claim 17, wherein the second magnetic part comprises a core part disposed inside the coil, and an outer peripheral part disposed outside the coil part, each of the core part and the outer peripheral part comprising metal powder having shape isotropy define inner edge and outer edge of the first magnetic part respectively.

20. The coil electronic component of claim 19, wherein the core part and the outer peripheral part each further comprise the metal powder having the shape anisotropy.

21. The coil electronic component of claim 18, comprising a first layer comprising metal powder having shape isotropy, connecting the first and second cover parts to each other, and penetrating a region enclosed by the coil part.

22. The coil electronic component of claim 18, comprising a second layer comprising metal powder having shape isotropy, connecting the first and second cover parts to each other, and disposed outside the coil part.

* * * * *